United States Patent [19]

Poulton

[11] Patent Number: 5,033,706

[45] Date of Patent: Jul. 23, 1991

[54] RIGGING FRAME

[75] Inventor: Barrie A. Poulton, Cheltenham, England

[73] Assignee: Flomat Limited, Derbyshire, England

[21] Appl. No.: 526,644

[22] Filed: May 21, 1990

[30] Foreign Application Priority Data

Jun. 6, 1989 [GB] United Kingdom ..... 8912987

[51] Int. Cl.[5] ..... A47G 23/02

[52] U.S. Cl. ..... 248/149; 222/105

[58] Field of Search ..... 248/149, 97; 414/403, 414/415; 222/105, 612, 181, 630; 150/41

[56] References Cited

U.S. PATENT DOCUMENTS

| | | | |
|---|---|---|---|
| 2,858,051 | 10/1958 | Cunningham | 222/105 X |
| 3,946,909 | 3/1976 | Wheeler | 222/181 |
| 4,165,024 | 8/1979 | Oswalt | 222/105 |
| 4,167,235 | 9/1979 | Green | 222/630 |
| 4,371,057 | 2/1983 | Blier | 182/184 |
| 4,790,708 | 12/1988 | Mackiewicz | 414/403 X |
| 4,836,421 | 6/1989 | Miyoshi | 222/166 |
| 4,966,311 | 10/1990 | Taylor | 222/181 X |

*Primary Examiner*—J. Franklin Foss

*Attorney, Agent, or Firm*—Charles J. Brown

[57] ABSTRACT

There is disclosed a rigging frame (10) having legs (15) whose lengths are adjustable to suit the frame for different sizes of "big bag" to avoid need for adjustment of the support means of a discharging machine.

2 Claims, 2 Drawing Sheets

RIGGING FRAME

This invention concerns equipment for handling powdered, granulated or otherwise particulated solid materials and more especially a rigging frame for intermediate bulk containers of the kind popularly known in the industry as "big bags".

The containers comprise large bag-like enclosures of flexible sheet material having either a base adapted to be cut to form an opening therein or discharge spout means at their lower ends and loops at their upper ends by which they may be suspended from a rigging frame adapted to be positioned on support means to hold the container over a discharging machine.

The containers may be of variable height, necessitating adjustment of the support means to ensure that their lower ends are correctly disposed relative to the discharging machine.

Generally such adjustment requires the weight of the container to be lifted from the support means using a fork-lift truck to enable bolts to be loosened and retightened to position the support means at a different level.

This operation is time-consuming and generally inconvenient.

It is an object of the present invention to provide material handling equipment which overcomes the problem aforesaid.

According to the present invention there is provided a rigging frame having legs whose lengths are adjustable.

Each leg may be comprised by a rod vertically slidable in a socket forming part of the frame.

The rod may be secured at one of a number of positions relative to the socket by a pin passing through lateral bores in the socket and one of a number of axially spaced bores through the rod.

The invention will be further apparent from the following description with reference to the figures of the accompanying drawings, which show, by way of example only, one form of rigging frame embodying same.

Figure 1:
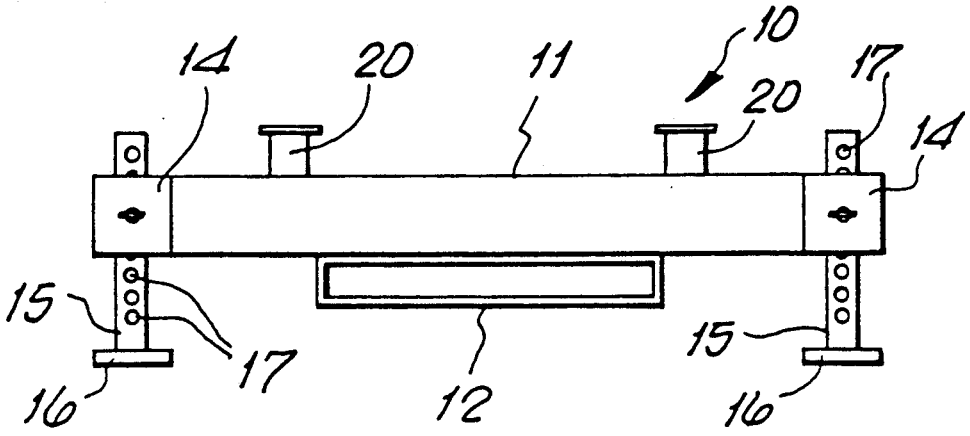
FIG. 1 shows a side elevation of the rigging frame.
Figure 2:
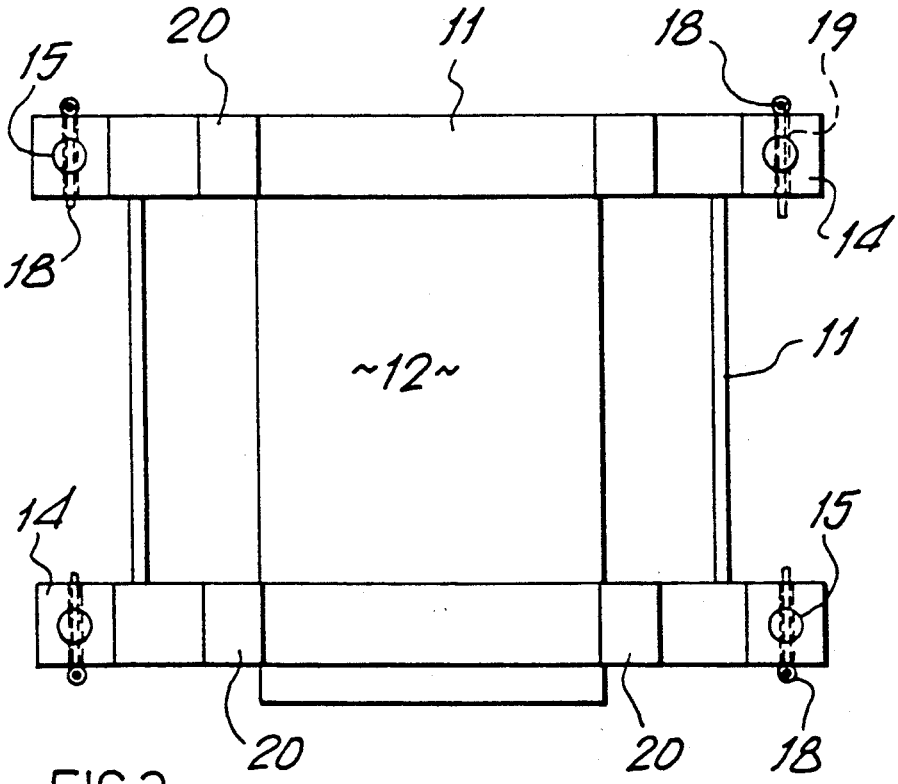
FIG. 2 shows a plan view of the rigging frame of FIG. 1.
Figure 3:
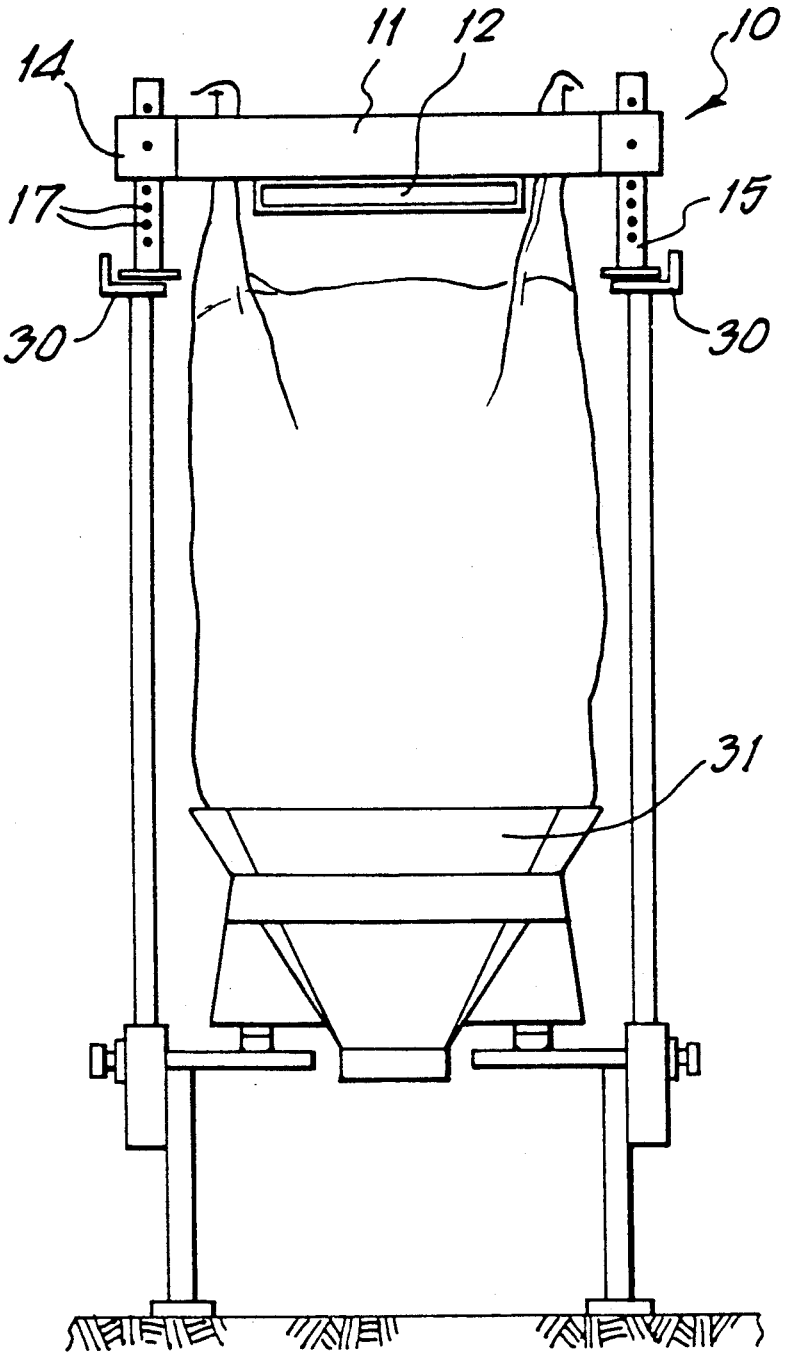
FIG. 3 shows the rigging frame in position on support means to hold a container over a discharging machine.

Referring firstly to FIGS. 1 and 2, it will be seen that the rigging frame generally indicated at 10 comprises a rectangular frame 11 mounted on a transverse box-section 12. The frame 10 may be raised and lowered by engagement of the forks of a fork-lift truck within the confines of the box-section 12.

At the four corners of the frame are socket members 14 each of which locates a rod 15 vertically slidable therein and forming a leg to the frame 10. The lower ends of the legs terminate in feet 16.

The rods 15 may be secured within the socket members 14 at one of a number of different positions to enable the length of the legs to be adjusted. Each rod 15 has a plurality of axially spaced diametric bores 17 therethrough and may be secured in its socket member 14 by a pin 18 passing through lateral bores 19 in the socket member and a selected one of the bores 17.

The frame 10 is provided with hooks 20 with which the loops at the top of a flexible intermediate bulk carrier or "big-bag" may be engaged so that the container may be suspended from the frame 10.

In use, a frame 10 is held by a fork-lift truck over a container whilst such is on a pallet and the container loops are engaged with the hooks 20. The frame is lifted to take the weight of the container. At this time the length of the legs to the frame may be adjusted so that feet 16 are at a predetermined distance from the ground, whereby when the feet 16 are positioned on the support means 30 of a discharging machine the lower end of the container will be correctly positioned relative to the receiving hopper 31 of the machine.

It will be appreciated that it is not intended to limit the invention to the above example only, many variations, such as might readily occur to one skilled in the art, being possible, without departing from the scope thereof as defined by the appended claims.

I claim:

1. For use with apparatus for locating a lower spout of a flexible intermediate carrier at a selected position over a discharge machine having fixed support surfaces, a rigging device comprising:

a) a rigid frame, b) hook means on the frame for attachment to an end of the carrier remote from its spout, c) means on the frame for engagement by a lifting device for lifting the carrier, d) vertically adjustable legs on the frame extendable downwardly to predetermined positions, and e) locking means for fixing the legs to the frame in said predetermined positions before the carrier is lifted to a position over the discharge machine, f) whereby when the carrier is lifted over the discharge machine by the lifting device the locked frame legs will stand on the fixed support surfaces of the discharge machine with the carrier spout at the correct selected position.

2. A rigging device according to claim 1 wherein the legs are rods slidable in sockets on the frame and the locking means are pins disposable in bores in the frame aligned with selected bores in the legs.

* * * * *